US008607847B2

(12) United States Patent
Schlichting et al.

(10) Patent No.: US 8,607,847 B2
(45) Date of Patent: Dec. 17, 2013

(54) METHOD FOR CASTING METAL STRIP WITH DYNAMIC CROWN CONTROL

(75) Inventors: Mark Schlichting, Crawfordsville, IN (US); Walter N. Blejde, Brownsburg, IN (US); Mike Schueren, Crawfordsville, IN (US); Rama Ballav Mahapatra, Brighton-le-Sands (AU)

(73) Assignee: Nucor Corporation, Charlotte, NC (US)

( * ) Notice: Subject to any disclaimer, the term of this patent is extended or adjusted under 35 U.S.C. 154(b) by 655 days.

(21) Appl. No.: 12/186,155

(22) Filed: Aug. 5, 2008

(65) Prior Publication Data

US 2010/0032128 A1 Feb. 11, 2010

(51) Int. Cl.

| | |
|---|---|
| ***B22D 11/00*** | (2006.01) |
| ***B22D 11/06*** | (2006.01) |
| ***B22D 11/16*** | (2006.01) |
| ***B22D 11/22*** | (2006.01) |

(52) U.S. Cl.
USPC ..... 164/463; 164/480; 164/452; 164/455

(58) Field of Classification Search
USPC ..... 164/463, 455, 452, 414, 443–444, 428, 164/480
See application file for complete search history.

(56) References Cited

U.S. PATENT DOCUMENTS

| | | | |
|---|---|---|---|
| 4,440,012 | A | 4/1984 | Feldmann et al. |
| 4,519,233 | A | 5/1985 | Feldmann et al. |
| 4,781,051 | A | 11/1988 | Schultes et al. |
| 4,798,074 | A | 1/1989 | Feldmann et al. |
| 4,800,742 | A | 1/1989 | Feldmann et al. |
| 4,881,396 | A | 11/1989 | Seidel et al. |
| 4,955,221 | A | 9/1990 | Feldmann et al. |
| 5,052,471 | A | 10/1991 | Ueda et al. |
| 5,477,911 | A | 12/1995 | Ginzburg |
| 5,560,421 | A | 10/1996 | Tanaka et al. |
| 5,592,987 | A | 1/1997 | Romanowski et al. |
| 5,651,281 | A | 7/1997 | Seidel |
| 5,697,244 | A | 12/1997 | Seidel |
| 5,787,967 | A | 8/1998 | Vendeville et al. |
| 5,943,896 | A | 8/1999 | Rosenthal et al. |
| 5,964,116 | A | 10/1999 | Bode et al. |
| 5,970,765 | A | 10/1999 | Seidel |

(Continued)

FOREIGN PATENT DOCUMENTS

| | | |
|---|---|---|
| EP | 0788854 A1 | 8/1997 |
| JP | 59030455 | 2/1984 |

(Continued)

OTHER PUBLICATIONS

Notification of Co-Pending Applications.

(Continued)

*Primary Examiner* — Kevin P Kerns
*Assistant Examiner* — Steven Ha
(74) *Attorney, Agent, or Firm* — Hahn, Loeser & Parks, LLP; Arland T. Stein

(57) ABSTRACT

A method of continuously casting thin strip dynamically controlling roll casting surface configuation by controlling the temperature of water flowing through the longitudinal water flow passages in a cyclindrical tube thickness of no more than 80 millimeters of counter rotated casting rolls, and varying the speed of the casting rolls with attenuation of the ends of the casting rolls with a casting roll drive system responsive to electrical signals received from sensors during a casting campaign.

12 Claims, 14 Drawing Sheets

(56) References Cited

U.S. PATENT DOCUMENTS

| | | | | |
|---|---|---|---|---|
| 5,996,680 | A * | 12/1999 | Fukase et al. | 164/428 |
| 6,038,906 | A | 3/2000 | Hartung et al. | |
| 6,079,480 | A | 6/2000 | Oka et al. | |
| 6,138,487 | A | 10/2000 | Hartung et al. | |
| 7,059,163 | B2 | 6/2006 | Hartung et al. | |
| 7,147,033 | B2 | 12/2006 | Yamamoto et al. | |
| 7,156,152 | B2 | 1/2007 | Hohenbichler | |
| 7,328,737 | B2 | 2/2008 | Hohenbichler | |
| 2003/0000678 | A1 * | 1/2003 | Nikolovski et al. | 164/413 |
| 2007/0169914 | A1 * | 7/2007 | Nakayama et al. | 164/428 |
| 2009/0294089 | A1 * | 12/2009 | Sato et al. | 164/151.2 |

FOREIGN PATENT DOCUMENTS

| | | | |
|---|---|---|---|
| JP | 64057956 | | 3/1989 |
| JP | 2-52149 | | 2/1990 |
| JP | 02307652 | | 12/1990 |
| JP | 07088599 | | 4/1995 |
| JP | 07276004 | | 10/1995 |
| JP | 2003019544 | | 1/2003 |
| WO | WO 2007129373 | A1 * | 11/2007 |

OTHER PUBLICATIONS

Machine Translation of Japanese Patent No. 2006-192479.

* cited by examiner

Graph : showing effect of inlet water temperature on roll temp

Graph : ~ Roll temperature and strip crown

Measured roll surface temperature across the width of the casting roll.

An example of heat flux curve showing heat flux attenuation.

Effect of heat flux attenuation at the edge on the thermal crown across the width of the roll.

| Location (mm) | Height (um) | Width (mm) | Area (mm2) |
|---|---|---|---|
| 259 | 12.035 | 114 | 0.667 |
| 348 | -8.375 | 69 | -0.296 |
| 388 | 8.256 | 40 | 0.192 |
| 477 | 11.194 | 124 | -0.934 |
| 650 | 30.626 | 104 | 1.74 |
| 823 | -11.16 | 119 | -0.895 |
| 922 | 12.259 | 40 | 0.307 |
| 1020 | -10.273 | 109 | -0.669 |
| 1134 | 13.467 | 114 | 0.903 |
| 1258 | -14.188 | 44 | -0.364 |

METHOD FOR CASTING METAL STRIP WITH DYNAMIC CROWN CONTROL

BACKGROUND AND SUMMARY

This invention relates to the casting of metal strip by continuous casting in a twin roll caster.

In a twin roll caster, molten metal is introduced between a pair of counter-rotated horizontal casting rolls that are cooled so that metal shells solidify on the moving roll surfaces and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow.

Further, the twin roll caster may be capable of continuously producing cast strip from molten steel through a sequence of ladles. Pouring the molten metal from the ladle into smaller vessels before flowing through the metal delivery nozzle enables the exchange of an empty ladle with a full ladle without disrupting the production of cast strip.

In casting thin strip by twin roll caster, the unpredictability of the crown in the casting surfaces of the casting rolls during a casting campaign is a difficulty. The crown of the casting surfaces of the casting rolls determines the thickness profile, i.e., cross-sectional shape, of thin cast strip produced by the twin roll caster. Casting rolls with convex (i.e., positive crown) casting surfaces produced cast strip with a negative (depressed) cross-sectional shape, and casting rolls with concave (i.e., negative crown) casting surfaces produced cast strip with a positive (i.e., raised) cross-sectional shape. The casting rolls generally are formed of copper or copper alloy with internal passages for circulation of cooling water usually coated with chromium or nickel to form the casting surfaces, which undergo substantial thermal deformation with exposure to the molten metal.

In thin strip casting, there is a desired roll crown to produce a desired strip cross-sectional profile under typical casting conditions. It is usual to machine the casting rolls with an initial crown when cold based on the projected crown in the casting surfaces of the casting rolls under typical casting condition. However, the differences between the crown shape of the casting surfaces between cold and casting conditions is difficult to predict. Moreover, the actual crown of the casting surfaces during the casting campaign can vary significantly from that projected crown under typical conditions, since the crown of the casting surfaces of the casting rolls can change even during typical casting due to changes in the temperature of molten metal supplied to the casting pool of the caster, changes in casting speed and other casting conditions, and even with slight changes in the composition of the molten metal as occurs during casting.

Accordingly, there has been a need for a reliable and effective way to directly and closely control the shape of the crown in the casting surfaces of the casting rolls during casting, and in turn, the cross-sectional profile of the thin cast strip produced by the twin roll caster. Previous proposals for casting roll crown control have relied on mechanical devices to physically deform the casting roll, e.g., by the movement of deforming pistons or other elements within the casting roll or by applying bending forces to the support shafts of the casting rolls. Yet, there has not been an effective way to dynamically control the roll crown to produce the desired profile of the cast strip until now.

We have determined that reliable and effective control of the casting roll crown and, in turn, cross-sectional strip profile can be achieved by providing a casting roll of such configuration to enable control of the crown in the casting surfaces by varying casting parameters.

Disclosed is a method of continuously casting thin strip dynamically controlling roll crown comprising the steps of:

a. assembling a caster having a pair of counter rotating casting rolls with a nip there between capable of delivering cast strip downwardly from the nip, where each casting roll has a casting surface formed by a cylindrical tube of a material selected from the group consisting of copper and copper alloy optionally with a coating thereon and having a plurality of longitudinal water flow passages extending through the tube having a thickness of no more than 80 millimeters, the cylindrical tube capable of changing crown of the casting surface with changes in temperature of water flowing through the passages during casting, b. assembling a metal delivery system capable of forming a casting pool supported on the casting surfaces of the casting rolls above the nip with side dams adjacent ends of the nip to confine the casting pool, c. positioning at least one sensor capable of sensing thickness profile of the cast strip downstream of the nip and generating electrical signals indicative of the thickness profile of the cast strip, d. controlling the temperature of the water flowing through the longitudinal water flow passages in the tube thickness, e. counter rotating the casting rolls and varying the speed of the casting rolls with a casting roll drive system, and f. controlling the casting roll drive to vary the speed of rotation of the casting rolls and varying the temperature of the water flow circulated through the water flow passages by a control system responsive to electrical signals received from the sensors to control roll crown of the casting rolls during a casting campaign.

The cylindrical tube of each casting roll is of a circumferential thickness that, by varying the casting speed and controlling the temperature of the water circulated through the casting rolls, the crown in the casting surfaces of the casting can reliably be varied to achieve and maintain a desired cross-sectional profile of the cast strip. The thickness of the cylindrical tube may range between 40 and 80 millimeters in thickness or between 60 and 80 millimeters in thickness. The casting rolls may have a cavity internal of the cylindrical tube to define the thickness of the cylindrical tube and facilitate flexure of the cylindrical tube to provide crown control with changes in casting speed and temperature of water circulated through the casting rolls. Water may be circulated through the water flow passages and the cavities of the casting rolls in series. Alternatively, water may be circulated through the water flow passages and then through the cavity of at least one of the casting rolls, or water may be circulated through the cavity and then through the water flow passages of at least one of the casting rolls.

Also disclosed is an apparatus for continuously casting thin strip by dynamically controlling roll crown comprising:

a. a caster having a pair of counter rotating casting rolls with a nip there between capable of delivering cast strip downwardly from the nip where each casting roll has a casting surface formed by a cylindrical tube of a material selected from the group consisting of copper and copper alloy optionally with a coating thereon and has a plurality of longitudinal water flow passages extending through the tube having a thickness of no more than 80 millimeters, the cylindrical tube capable of changing crown of the casting surface with changes in temperature of water flowing through the passages during casting, b. a metal delivery system capable of forming a casting pool supported on the casting surfaces of the casting rolls above the nip with side dams adjacent ends of the nip to confine the casting pool, c. at least one sensor capable of sensing thickness profile of the cast strip downstream of the nip and generating electrical signals indicative of the thickness profile of the cast strip, d. a water flow controller capable of controlling the temperature of the water flowing through the longitudinal water flow passages in the tube thickness, e. a casting roll drive system capable of counter rotating the casting rolls and varying the speed of the casting rolls during casting, and f. a control system responsive to electrical signals received from the sensors capable of controlling the casting roll drive to vary the speed of rotation of the casting rolls and controlling the water flow controller to vary the temperature of the water flow circulated through the water flow passages to control roll crown of the casting rolls during a casting campaign.

Again, the cylindrical tube may have an internal cavity to define the cylindrical tube and provide for flexure thereof as described above. Tube may be between 40 and 80 millimeters in thickness or between 60 and 80 millimeters in thickness.

The longitudinal water flow passages in the tube thickness may be arranged in three pass sets round the cylindrical tube thickness, so that the cooling water circulates through the three passages of the set in series before exiting the casting roll either directly or through the internal cavity. Alternatively, the longitudinal water flow passages in the tube thickness may be arranged in single pass sets round the cylindrical tube thickness so that the cooling water circulates through one passage before exiting the casting roll either directly or through the internal cavity.

At least one sensor capable of sensing thickness profile of the cast strip may be adjacent to pinch rolls through which the strip first passes after casting. A plurality of sensors capable of sensing thickness profile of the cast strip may be positioned laterally across the strip.

Various aspects of the invention will become apparent to those skilled in the art from the following detailed description, drawings and claims.

BRIEF DESCRIPTION OF THE DRAWINGS

The invention is described in more detail in reference to the accompanying drawings in which.

DETAILED DESCRIPTION

Figure 1:
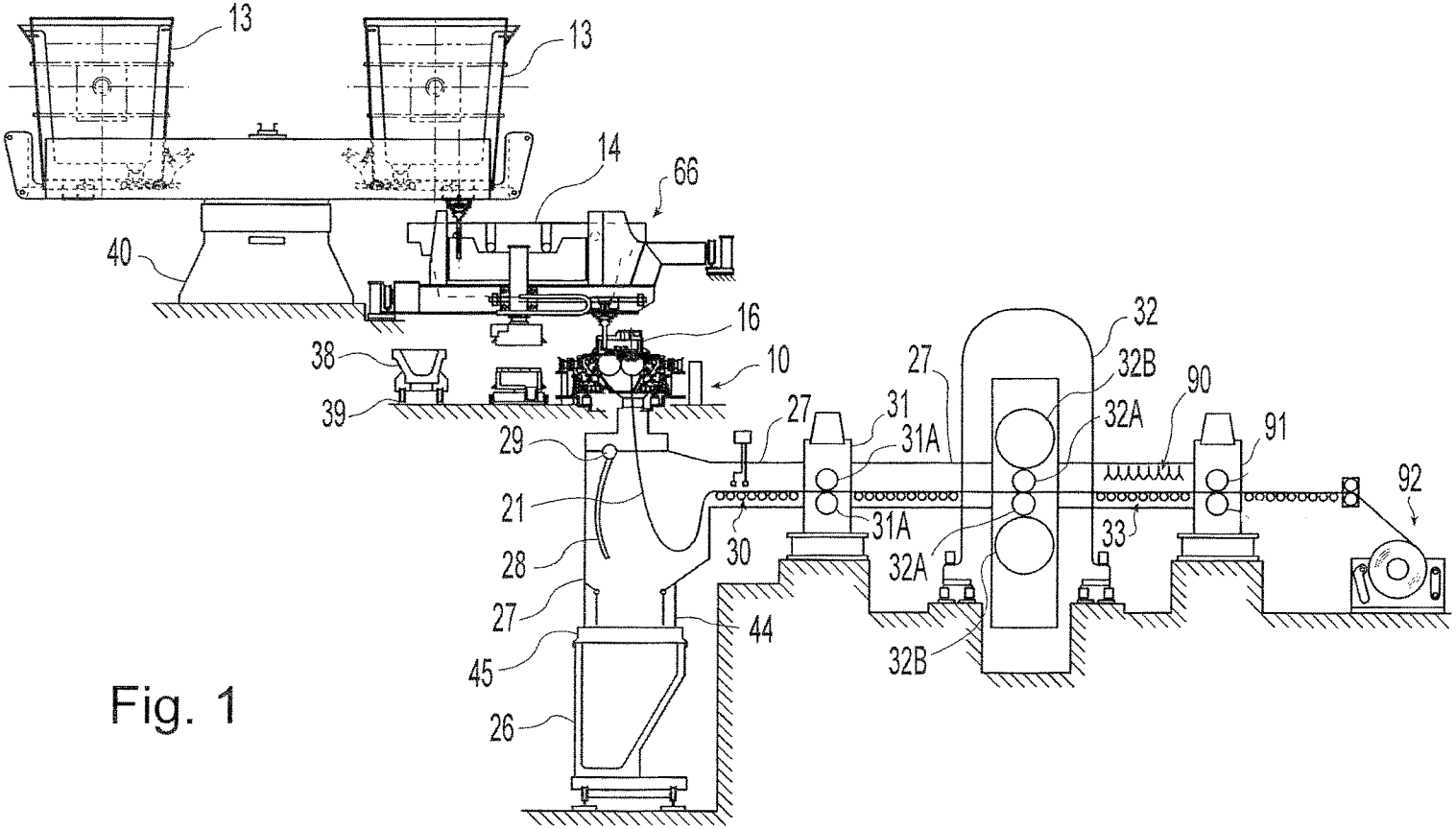
FIG. 1 is a diagrammatical side view of a twin roll caster of the present disclosure.
Figure 2:
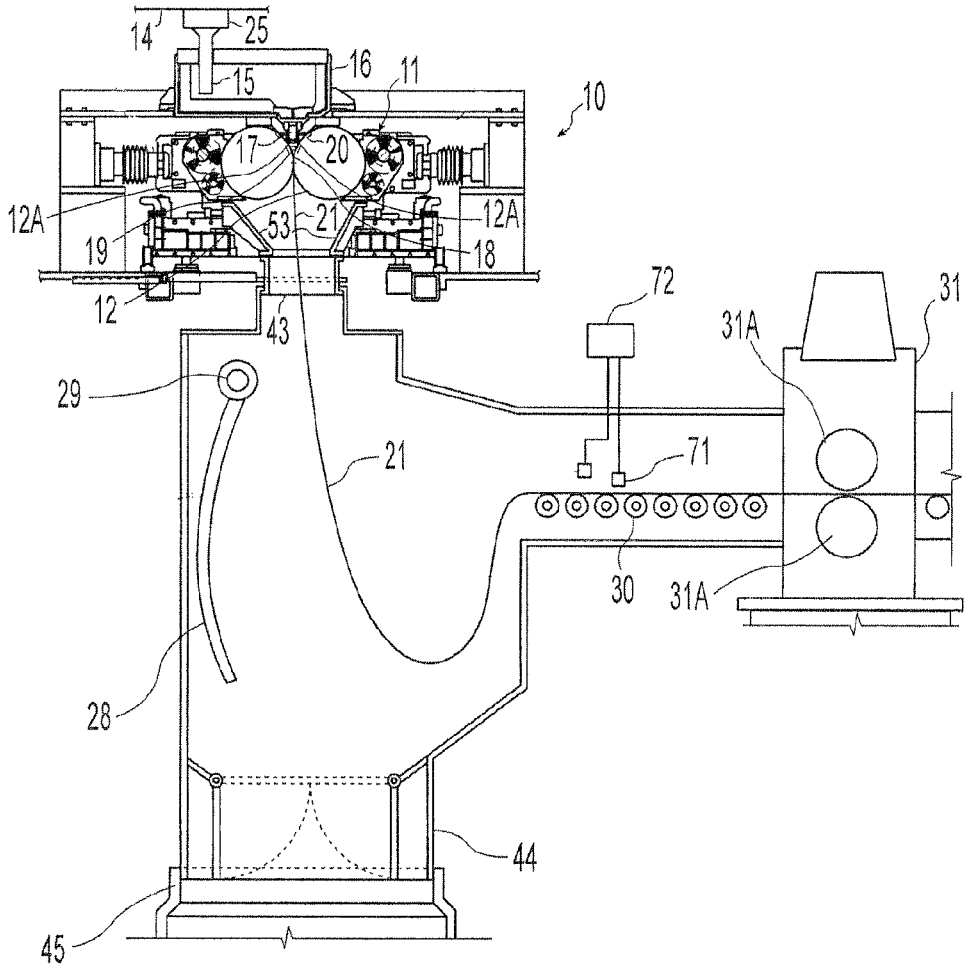
FIG. 2 is an enlarged partial sectional view of a portion of the twin roll caster of FIG. 1 including a strip inspection device for measuring strip profile.
Figure 2A:
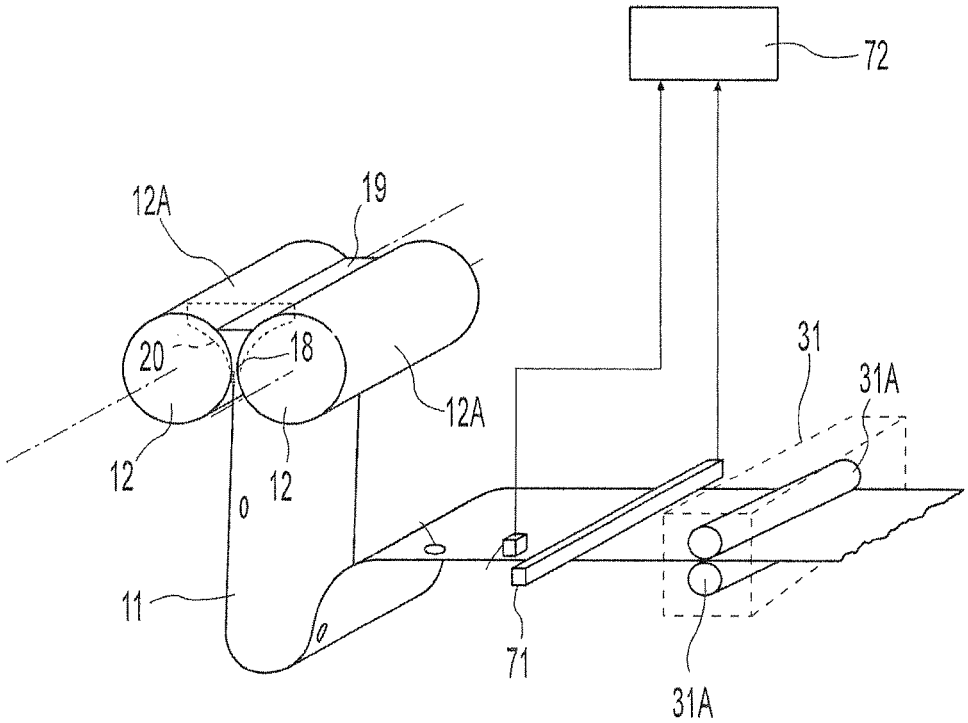
FIG. 2A is a schematic view of a portion of twin roll caster of FIG. 2.
Figure 3A:
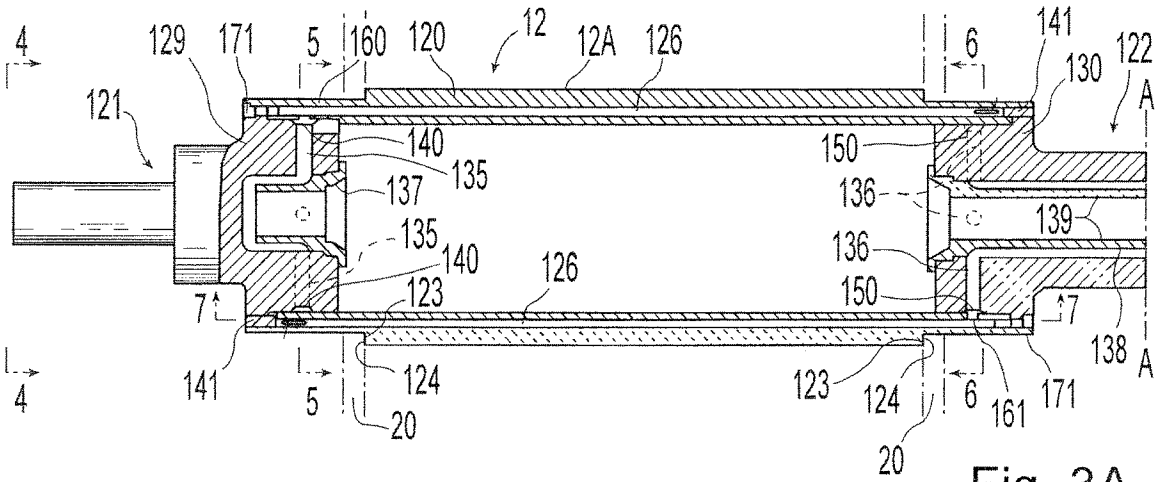
FIG. 3A is a cross sectional view longitudinally through a portion of one of the casing rolls of FIG. 2.
Figure 3B:
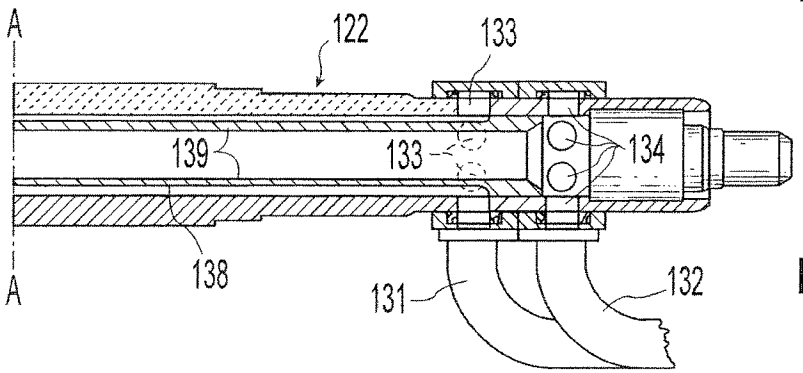
FIG. 3B is a cross sectional view longitudinally through the remaining portion of the casing roll of FIG. 3A joined on line A-A.

Referring now to FIGS. 1, 2, and 2A, a twin roll caster is illustrated that comprises a main machine frame 10 that stands up from the factory floor and supports a pair of counter-Rotatable casting rolls 12 mounted in a module in a roll cassette 11. The casting rolls 12 are mounted in the roll cassette 11 for ease of operation and movement as described below. The roll cassette 11 facilitates rapid movement of the casting rolls 12 ready for casting from a setup position into an operative casting position in the caster as a unit, and ready removal of the casting rolls 12 from the casting position when the casting rolls 12 are to be replaced. There is no particular configuration of the roll cassette 11 that is desired, so long as it performs that function of facilitating movement and positioning of the casting rolls 12 as described herein.

The casting apparatus for continuously casting thin steel strip includes the pair of counter-Rotatable casting rolls 12 having casting surfaces 12A laterally positioned to form a nip 18 there between. Molten metal is supplied from a ladle 13 through a metal delivery system to a metal delivery nozzle 17, core nozzle, positioned between the casting rolls 12 above the nip 18. Molten metal thus delivered forms a casting pool 19 of molten metal above the nip 18 supported on the casting surfaces 12A of the casting rolls 12. This casting pool 19 is confined in the casting area at the ends of the casting rolls 12 by a pair of side closure plates, or side dams 20, (shown in dotted line in FIGS. 2 and 2A). The upper surface of the casting pool 19 (generally referred to as the "meniscus" level) may rise above the lower end of the delivery nozzle 17 so that the lower end of the delivery nozzle 17 is immersed within the casting pool 19. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to fill the tundish 14 with molten metal. The movable tundish 14 may be positioned on a tundish car 66 capable of transferring the tundish 14 from a heating station (not shown), where the tundish 14 is heated to near a casting temperature, to the casting position. A tundish guide, such as rails 39, may be positioned beneath the tundish car 66 to enable moving the movable tundish 14 from the heating station to the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The side dams 20 may be made from a refractory material such as zirconia graphite, graphite alumina, boron nitride, boron nitride-zirconia, or other suitable composites. The side dams 20 have a face surface capable of physical contact with the casting rolls 12 and molten metal in the casting pool 19. The side dams 20 are mounted in side dam holders (not shown), which are movable by side dam actuators (not shown), such as a hydraulic or pneumatic cylinder, servo mechanism, or other actuator to bring the side dams 20 into engagement with the ends of the casting rolls 12. Additionally, the side dam actuators are capable of positioning the side dams 20 during casting. The side dams 20 form end closures for the molten pool of metal on the casting rolls 12 during the casting operation.

FIG. 1 shows the twin roll caster producing the cast strip 21, which passes across a guide table 30 to a pinch roll stand 31, comprising pinch rolls 31A. Upon exiting the pinch roll stand 31, the thin cast strip 21 may pass through a hot rolling mill 32, comprising a pair of work rolls 32A, and backup rolls 32B, forming a gap capable of hot rolling the cast strip 21 delivered from the casting rolls 12, where the cast strip 21 is hot rolled to reduce the strip to a desired thickness, improve the strip surface, and improve the strip flatness. The work rolls 32A have work surfaces relating to the desired strip profile across the work rolls 32A. The hot rolled cast strip 21 then passes onto a run-out table 33, where it may be cooled by contact with a coolant, such as water, supplied via water jets 90 or other suitable means, and by convection and radiation. In any event, the hot rolled cast strip 21 may then pass through a second pinch roll stand 91 to provide tension of the cast strip 21, and then to a coiler 92. The cast strip 21 may be between about 0.3 and 2.0 millimeters in thickness before hot rolling.

At the start of the casting operation, a short length of imperfect strip is typically produced as casting conditions stabilize. After continuous casting is established, the casting rolls 12 are moved apart slightly and then brought together again to cause this leading end of the cast strip 21 to break away forming a clean head end of the following cast strip 21. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls 12 in enclosure 27 before it passes to the guide table 30 where it engages a succession of guide rollers.

An overflow container 38 may be provided beneath the movable tundish 14 to receive molten material that may spill from the tundish 14. As shown in FIG. 1, the overflow container 38 may be movable on rails 39 or another guide such that the overflow container 38 may be placed beneath the movable tundish 14 as desired in casting locations. Additionally, an optional overflow container (not shown) may be provided for the distributor 16 adjacent the distributor 16.

The sealed enclosure 27 is formed by a number of separate wall sections that fit together at various seal connections to form a continuous enclosure wall that permits control of the atmosphere within the enclosure 27. Additionally, the scrap receptacle 26 may be capable of attaching with the enclosure 27 so that the enclosure 27 is capable of supporting a protective atmosphere immediately beneath the casting rolls 12 in the casting position. The enclosure 27 includes an opening in the lower portion of the enclosure 27, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed," "sealing," and "sealingly" in reference to the scrap receptacle 26, enclosure 27, and related features may not be a complete seal so as to prevent leakage, but rather is usually less than a perfect seal as appropriate to allow control and support of the atmosphere within the enclosure 27 as desired with some tolerable leakage.

A rim portion 45 may surround the opening of the lower enclosure portion 44 and may be movably positioned above the scrap receptacle 26, capable of sealingly engaging and/or attaching to the scrap receptacle 26 in the scrap receiving position. The rim portion 45 may be movable between a sealing position in which the rim portion 45 engages the scrap receptacle 26, and a clearance position in which the rim portion 45 is disengaged from the scrap receptacle 26. Alternately, the caster or the scrap receptacle 26 may include a lifting mechanism to raise the scrap receptacle 26 into sealing engagement with the rim portion 45 of the enclosure 27, and then lower the scrap receptacle 26 into the clearance position. When sealed, the enclosure 27 and scrap receptacle 26 are filled with a desired gas, such as nitrogen, to reduce the amount of oxygen in the enclosure 27 and provide a protective atmosphere for the cast strip 21.

The enclosure 27 may include an upper collar portion 43 supporting a protective atmosphere immediately beneath the casting rolls 12 in the casting position. When the casting rolls 12 are in the casting position, the upper collar portion 43 is moved to the extended position closing the space between a housing portion 53 adjacent the casting rolls 12, as shown in FIG. 2, and the enclosure 27. The upper collar portion 43 may be provided within or adjacent the enclosure 27 and adjacent the casting rolls 12, and may be moved by a plurality of actuators (not shown) such as servo-mechanisms, hydraulic mechanisms, pneumatic mechanisms, and rotating actuators.

The casting rolls 12 are internally water cooled as described below so that as the casting rolls 12 are counter-rotated, shells solidify on the casting surfaces 12A, as the casting surfaces 12A move into contact with and through the casting pool 19 with each revolution of the casting rolls 12. The shells are brought close together at the nip 18 between the casting rolls 12 to produce a thin cast strip product 21 delivered downwardly from the nip 18. The thin cast strip product 21 is formed from the shells at the nip 18 between the casting rolls 12 and delivered downwardly and moved downstream as described above.

The construction of each of the two casting rolls 12 is generally the same as described with reference to FIGS. 3A, 3B, and 4-7. Each casting roll 12 includes a cylindrical tube 120 of a metal selected from the group consisting of copper and copper alloy, optionally with a coating thereon, e.g., chromium or nickel, to form the casting surfaces 12A. Each cylindrical tube 120 may be mounted between a pair of stub shaft assemblies 121 and 122. The stub shaft assemblies 121 and 122 have end portions 127 and 128, respectively (shown in FIGS. 4-6), which fit snugly within the ends of cylindrical tube 120 to form the casting roll 12. The tube cylindrical 120 is thus supported by end portions 127 and 128 having flange portions 129 and 130, respectively, to form internal cavity 163 therein, and support the assembled casting roll between the stub shaft assemblies 121 and 122.

The outer cylindrical surface of each cylindrical tube 120 is a roll casting surface 12A. The cylindrical thickness of the cylindrical tube 120 may be no more than 80 millimeters thick so that crown of the outer surface of the cylindrical tube 120 can be controlled by controlling the casting speed and the temperature of the cooling water circulates through the casting roll as described below. The thickness of the tube 120 may range between 40 and 80 millimeters in thickness or between 60 and 80 millimeters in thickness.

Each cylindrical tube 120 is provided with a series of longitudinal water flow passages 126, which may be formed by drilling long holes through the circumferential thickness of the cylindrical tube 120 from one end to the other. The ends of the holes are subsequently closed by end plugs 141 attached to the end portions 127 and 128 of stub shaft assemblies 121 and 122 by fasteners 171. The water flow passages 126 are formed through the thickness of the cylindrical tube 120 with end plugs 141. The number of stub shaft fasteners 171 and end plugs 141 may be selected as desired. End plugs 141 may be arranged to provide, with water passage in the stub shaft assemblies described below, in single pass cooling from one end to the other of the roll 12, or alternatively, to provide multi-pass cooling where, for example, the flow passages 126 are connected to provide three passes of cooling water through adjacent flow passages 126 before returning the water to the water supply directly or through the cavity 163.

The water flow passages 126 through the thickness of the cylindrical tube 120 may be connected to water supply in series with the cavity 163. The water passages 126 may be connected to the water supply so that the cooling water first passes through the cavity 163 and then the water supply passages 126 to the return lines, or first through the water supply passages 126 and then through the cavity 163 to the return lines.

The cylindrical tube 120 may be provided with circumferential steps 123 at end to form shoulders 124 with the working portion of the roll casting surface 12A of the roll 12 there between. The shoulders 124 are arranged to engage the side dams 20 and confine the casting pool 19 as described above during the casting operation.

Figure 4:
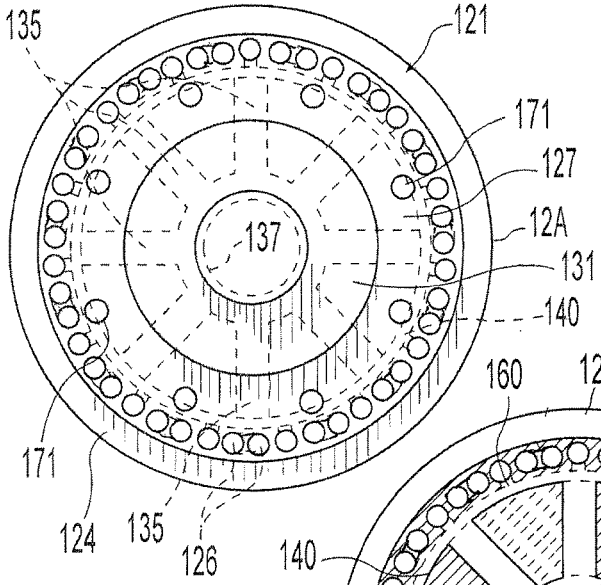
FIG. 4 is an end view of the casting roll of FIG. 3A on line 4-4 shown in partial interior detail in phantom.
Figure 5:
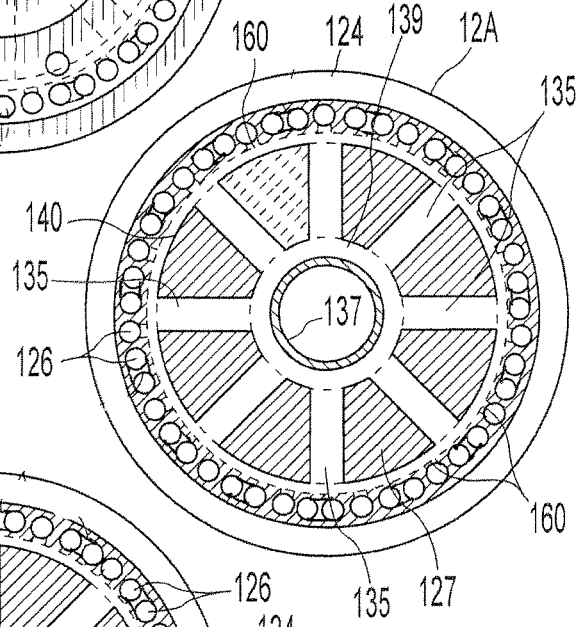
FIG. 5 is a cross sectional view of the casting roll of FIG. 3A on line 5-5.
Figure 6:
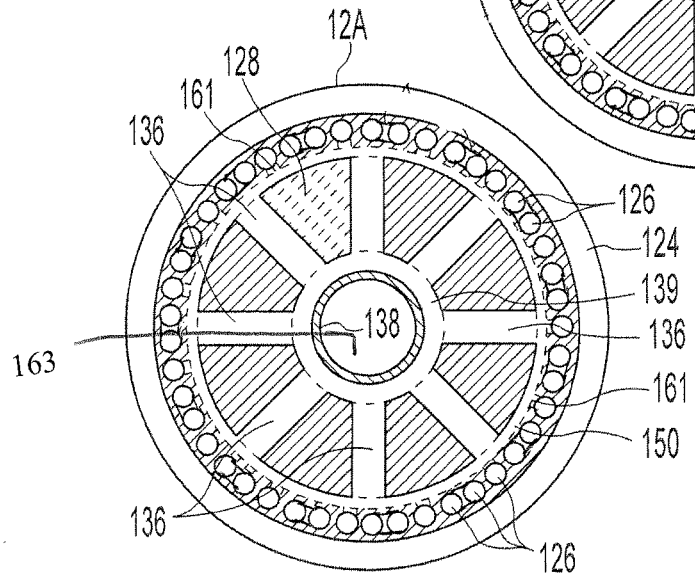
FIG. 6 is a cross sectional view of the casting roll of FIG. 3A on line 6-6.

End portions 127 and 128 of stub shaft assemblies 121 and 122, respectively, typically sealingly engage the ends of cylindrical tube 120 and have radially extending water passages 135 and 136 shown in FIGS. 4-6 to deliver water to the water flow passages 126 extending through the cylindrical tube 120. The radial flow passages 135 and 136 are connected to the ends of at least some of the water flow passages 126, for example, in threaded arrangement, depending on whether the cooling is a single pass or multi-pass cooling system. The remaining ends of the water flow passages 126 may be closed by, for example, threaded end plugs 141 as described where the water cooling is a multi-pass system.

Figure 7:
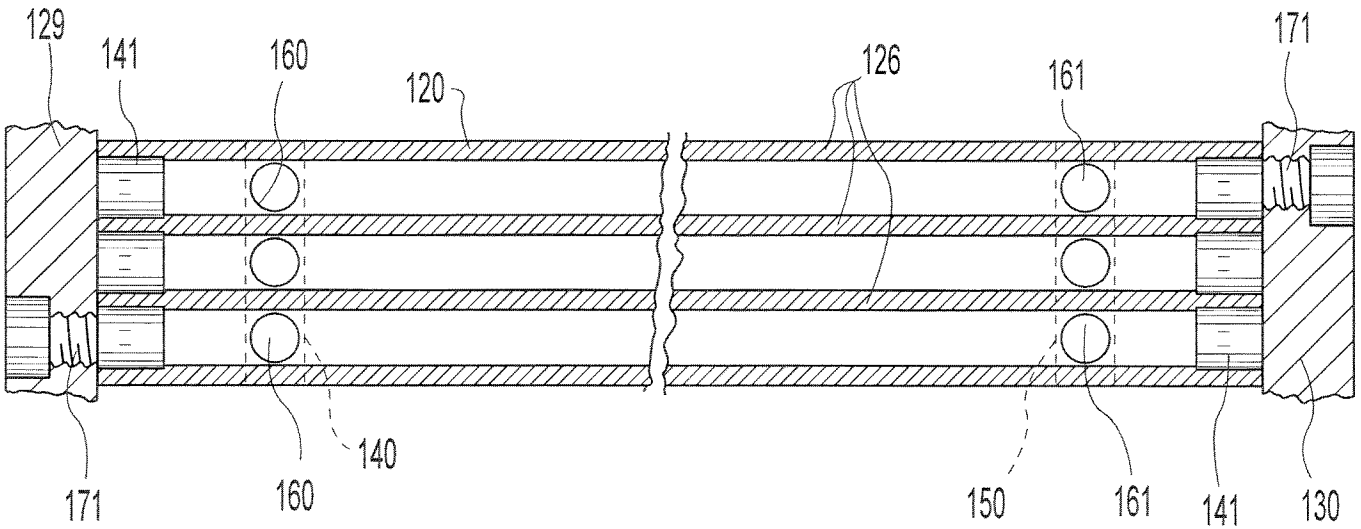
FIG. 7 is a cross sectional view of the casting roll of FIG. 3A on line 7-7.

As shown in detail by FIG. 7, cylindrical tube 120 may be positioned in annular arrays in the thickness of cylindrical tube 120 either in single pass or multi-pass arrays of water flow passages 126 as desired. The water flow passages 126 are connected at one end of the casting roll 12 by radial ports 160 to the annular gallery 140 and in turn radially flow passages 135 of end portion 127 in stub shaft assembly 120, and are connected at the other end of the casting roll 12 by radial ports 161 to annular gallery 150 and in turn radial flow passages 136 of end portions 128 in stub shaft assembly 121. Water supplied through one annular gallery, 140 or 150, at one end of the roll 12 can flow in parallel through all of the water flow passages 126 in a single pass to the other end of the roll 12 and out through the radial passages, 135 or 136, and the other annular gallery, 150 or 140, at that other end of the cylindrical tube 120. The directional flow may be reversed by appropriate connections of the supply and return line(s) as desired. Alternatively or additionally, selective ones of the water flow passages 126 may be optionally connected or blocked from the radial passages 135 and 136 to provide a multi pass arrangement, such as a three pass.

The stub shaft assembly 122 may be longer than the stub shaft assembly 121, and the stub shaft assembly 122 provided with two sets of water flow ports 133 and 134. Water flow ports 133 and 134 are capable of connection with rotary water flow couplings 131 and 132 by which water is delivered to and from the casting roll 12 axially through stub shaft assembly 122. In operation, cooling water passes to and from the water flow passages 126 in the cylindrical tube 120 through radial passages 135 and 136 extending through end portions 127 and 128 of the stub shaft assemblies 121 and 122, respectively. The stub shaft assembly 121 is fitted with axial tube 137, to provide fluid communication between the radial passages 135 in end portions 127 and the central cavity within the casting roll 12. The stub shaft assembly 122 is fitted with axial space tube 138, to separate a central water duct 138, in fluid communication with the central cavity 163, and from annular water flow duct 139 in fluid communication with radial passages 136 in end portion 122 of stub shaft assembly 122. Central water duct 138 and annular water duct 139 are capable of providing inflow and outflow of cooling water to and from the casting roll 12. In operation, incoming cooling water may be supplied through supply line 131 to annular duct 139 through ports 133, which is in turn in fluid communication with the radial passages 136, gallery 150 and water flow passages 126, and then returned through the gallery 140, the radial passages 135, axial tube 137, central cavity 163, and central water duct 138 to outflow line 132 through water flow ports 134. Alternatively, the water flow to, from and through the casting roll 12 may be in the reverse direction as desired. As discussed in more detail below, the water flow ports 133 and 134 may be connected to water supply and return lines so that water may flow to and from water flow passages 126 in the cylindrical tube 120 of the casting roll 12 in either direction, as desired. Depending on the direction of flow, the cooling water flows through the cavity 163 either before or after flow through the water flow passages 126.

Figure 8:
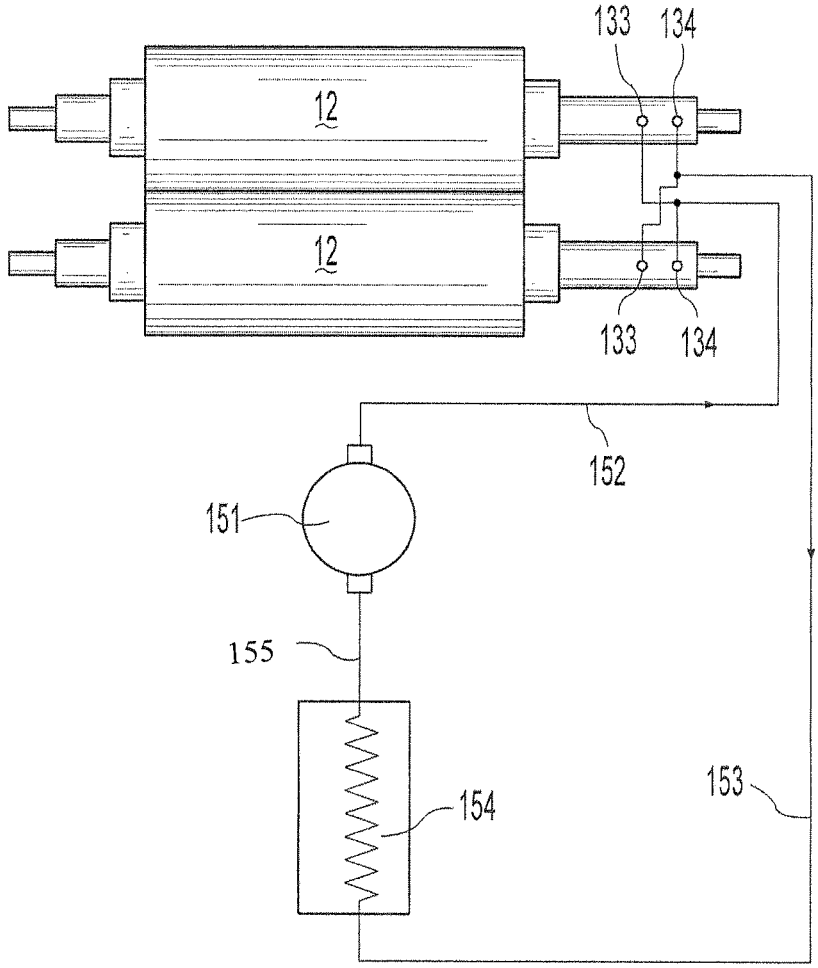
FIG. 8 is a schematic illustration of the twin casting rolls of FIG. 2 with a water supply system.

FIG. 8 illustrates one arrangement in which cooling water may be supplied to the casting rolls 12 in a closed loop system. A pump 151 delivers water through a supply line 152 to the ports 133 of one casting roll 12, and to the ports 134 of the other casting roll 12. By this arrangement, water is delivered to the radial passages 135 at one end of one casting roll 12 and to the radial passages 136 at the other end of the second casting roll 12. Water flows from the other ports, 134 and 133 respectively, through a discharge line 153 to a heat exchanger 154 and back to the pump 151 through a return line 155. Both of the casting rolls 12 may receive cooling water from the common supply pump 151 at essentially the same temperature, although such is not required. However, water is delivered to the flow passages 126 of one casting roll 12 through cavity 163, and discharge from the flow passages 126 of the other casting roll 12 through cavity 163. By this arrangement, differential expansion due to a temperature difference across one casting roll 12 tends to be offset by differential expansion of the other casting roll 12 due to the mutual reversal of the flow direction to the two rolls 12.

It is understood, however, that the water flow pattern and direction may be chosen as desired. For example, the direction of water flow may be the same in both casting rolls 12 by connection of the water supply in an arrangement illustrated in FIG. 9. Components illustrated in FIG. 9 that are similar to FIG. 8. However, in FIG. 9, the water supply line 152 is connected to the ports 133 of both rolls 12 and the discharge line 153 is connected to the ports 134 of both rolls 12.

Figure 9:
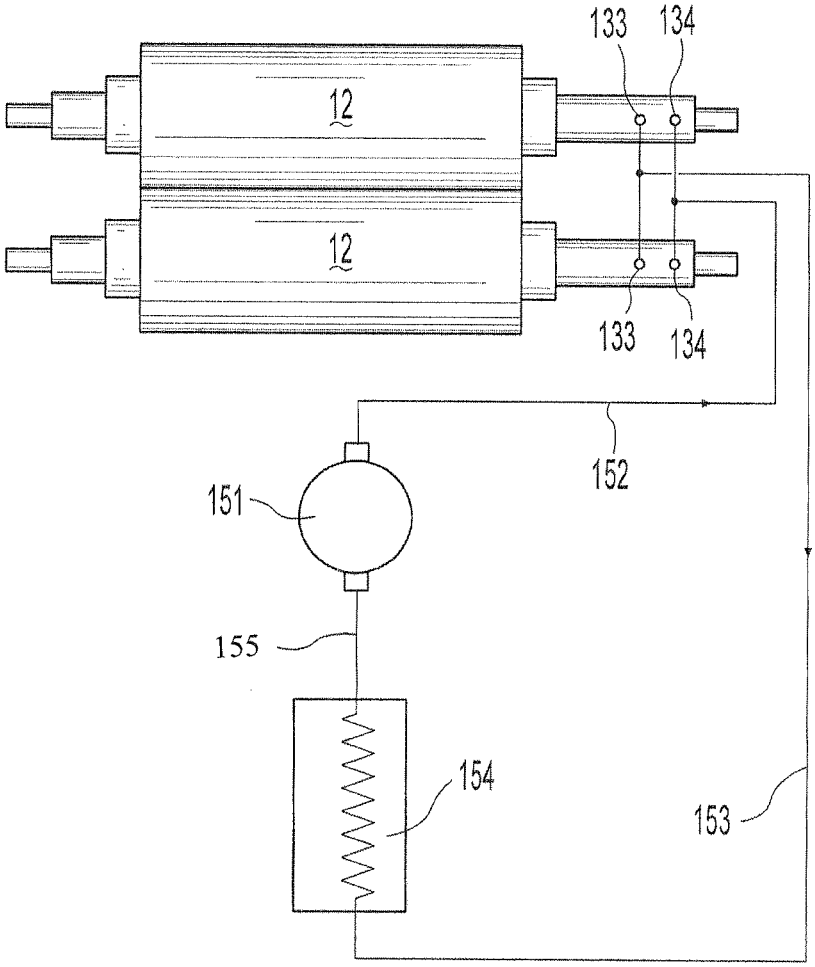
FIG. 9 is a schematic illustration similar to FIG. 8 with the water supply in an alternative configuration.

The systems illustrated in FIGS. 8 and 9 may be operated to control the crown of the casting surfaces 12A of the casting rolls 12. In operation, deformation of the crown of the casting surfaces 12A may be controlled by regulating the temperature of the cooling water flowing through the water flow passages 126 of the cylindrical tube 120 or controlling the speed of rotation of the casting rolls 12 with heat flux attenuation of the ends of the casting roll. In turn, the thickness profile of cast strip 21 can be controlled with the control of the crown of the casting surfaces 12A of the casting rolls 12. Since the circumferential thickness of the cylindrical tube 120 is made to a thickness of no more than 80 mm, the crown of the casting surfaces 12A may be made to deform responsive to changes in the temperature of the cooling water or change in speed of the casting rolls with heat flux attenuation of the ends of the casting roll. As previously explained, the thickness of the cylindrical tube 120 may range between 40 and 80 millimeters in thickness or between 60 and 80 millimeters in thickness.

To control the temperature of the cooling water and casting speed to achieve a desired strip thickness profile, a strip thickness profile sensor 71 may be positioned downstream to detect the thickness profile of the cast strip 21 as shown in FIGS. 2 and 2A. The strip thickness sensor 71 is provided typically between the nip 18 and the pinch rolls 31A to provide for direct control of the casting roll 12. The sensor may be an x-ray gauge or other suitable device capable of directly measuring the thickness profile across the width of the strip periodically or continuously. Alternatively, a plurality of non-contact type sensors are arranged across the cast strip 21 at the roller table 30 and the combination of thickness measurements from the plurality of positions across the cast strip 21 are processed by a controller 72 to determine the thickness profile of the strip periodically or continuously. The thickness profile of the cast strip 21 may be determined from this data periodically or continuously as desired.

FIGS. 10-18 are a series of graphs obtained from a twin roll caster similar to that illustrated in FIGS. 1-9. In several runs, the caster was operated at different set casting speeds, and with cooling water supplied at different inlet temperatures during the course of a casting run at each casting speed. In the twin roll caster utilized in these runs, the casting rolls comprised a cylindrical tube of copper alloy having an outer peripheral diameter of 489.6 mm, a length of 1400 mm and a circumferential thickness of 64.5 mm.

Figure 10:
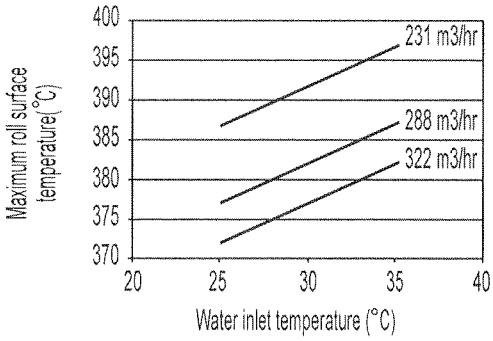
FIG. 10 is a graph illustrating maximum roll surface temperature to water inlet temperature for three different flows rates.

FIG. 10 is a graph illustrating the maximum measured roll surface temperature increases with increasing water inlet temperature at three different water flow rates. FIG. 10 also shows that the maximum measured roll surface temperature at a given water inlet temperature increases with decreasing water flow rate.

Figure 11:
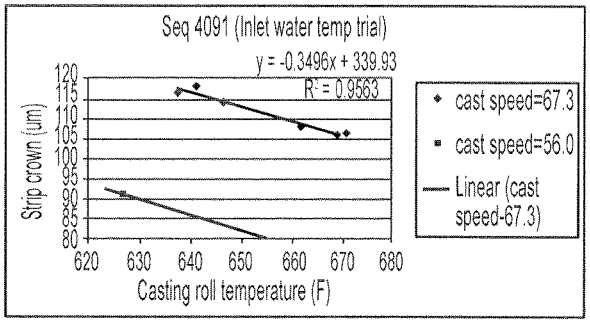
FIG. 11 is a graph illustrating strip crown to roll surface temperature for two different casting speeds.

FIG. 11 is a graph of strip thickness profile (strip crown) versus average measured roll surface temperature (i.e. the average roll surface temperature measured across the width of the roll) at two casting roll speeds. FIG. 11 shows that strip thickness profile reduces with increasing average measured roll temperature, as roll crown increases. Thus, strip thickness profile can be varied and controlled with the casting roll temperature and correlated water inlet temperature. FIG. 11 also shows that at a given casting roll temperature, the thickness profile (strip crown) markedly decreases with decreasing casting speed and heat flux attenuation of the ends of the casting roll as discussed below in relation to FIGS. 12-14.

Figure 12:
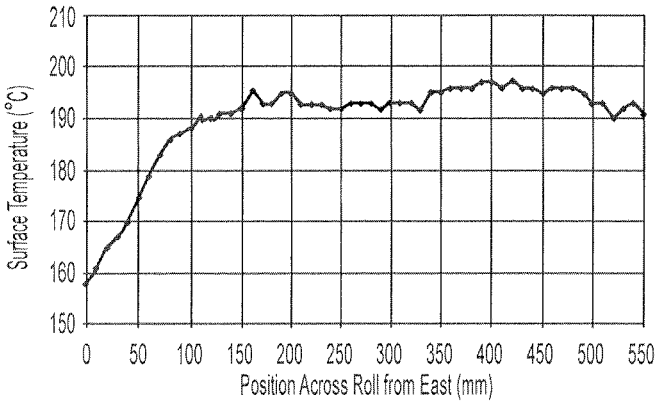
FIG. 12 is a graph illustrating roll surface temperature across a part of the width of a casting roll.

FIG. 12 is a graph of roll surface temperature across a part of the casting roll width in millimeters from one end of the casting roll, with the casting roll operating at a substantially constant casting speed. The graph illustrates that there is a substantial increase in casting roll surface temperature, of the order of 30° C., from the end of the casting roll to a position approximately 150 mm inboard of the end of the casting roll.

Figure 13:
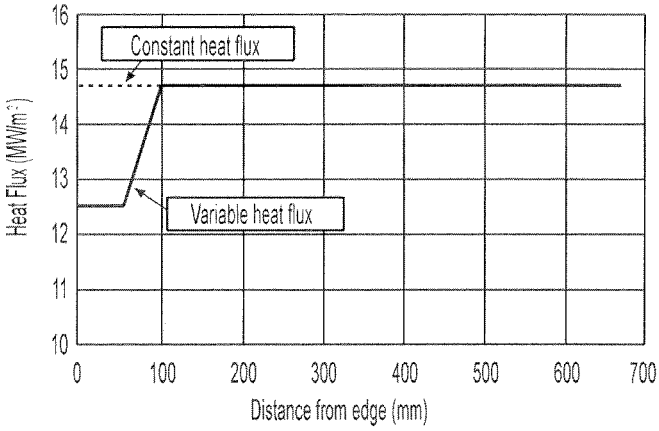
FIG. 13 is a graph illustrating heat flux to edge distance for the casting roll of FIG. 12.

FIG. 13 shows heat flux versus distance from the end of the casting roll. The variable heat flux curve is derived from calculations of the data set forth in the graph in FIG. 12. The constant heat flux curve is the theoretical limit which the heat flux approaches at the end of the strip with increase in casting speed. The variable heat flux curve in FIG. 13 illustrates significant attenuation of the heat flux at the ends of the casting roll with actual casting.

Figure 14:
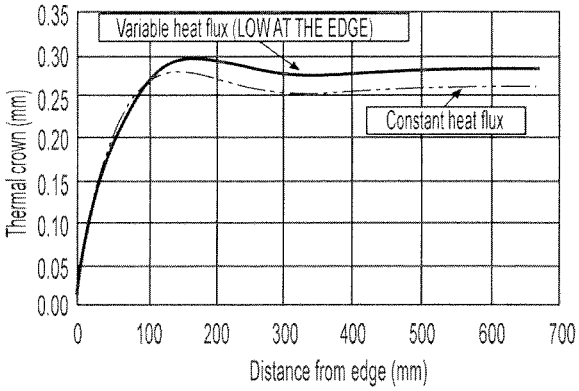
FIG. 14 is a graph illustrating thermal crown to edge distance for the casting roll of FIG. 12.

FIG. 14 illustrates the effect of the end heat flux attenuation shown in FIG. 13. FIG. 14 is a graph of change in casting surface configuration (roll crown) with distance from the end of the casting roll for the roll operation that generated the data illustrated in FIGS. 12 and 13, i.e., for variable heat flux across the width of the roll, and for casting roll operation with a constant heat flux generated across the width of the roll. FIG. 14 shows the difference between the casting roll crown in the central section of a casting roll operating under variable heat flux compared to a constant heat flux. We have also found that with the heat flux lower at the end of a casting roll compared to 150 millimeters from the ends of the roll, more constraint to the overall axial expansion of the casting roll and greater radial expansion results at the center of the casting roll, i.e., greater roll crown, in the central section of the casting roll and a reduced thickness profile of the strip. In other runs, similar results have been obtained with different casting speeds, with the results showing greater heat flux attenuation with decreasing casting speed.

Figure 15:
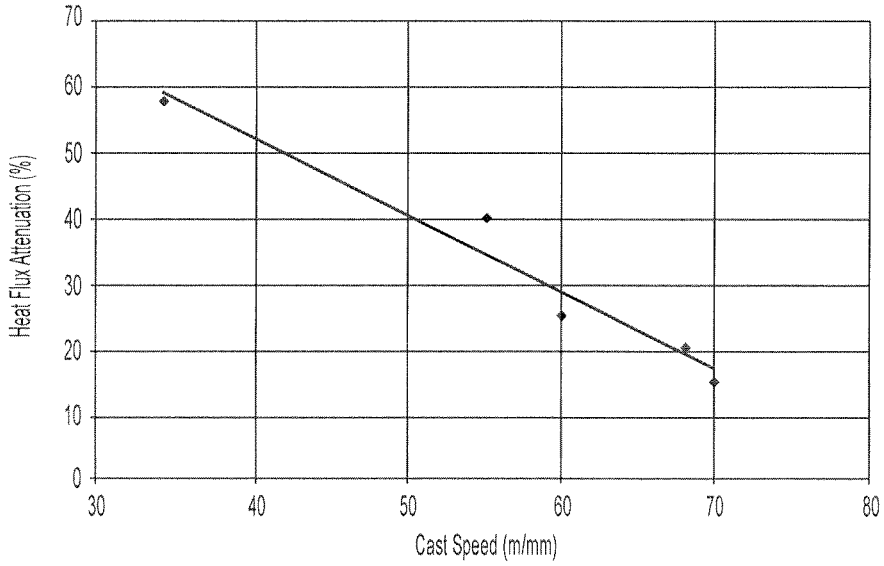
FIG. 15 is a graph illustrating heat flux attenuation to casting speed.

FIG. 15 is a graph of heat flux attenuation versus casting speed. The graph illustrates our finding that when casting occurs at lower casting speeds, the temperature profile of the crown in the surface of a casting roll over the last 150 millimeters from the side edge increases (even though the average temperature of the casting roll is lower). This has the effect of constraining the cylindrical tube of the casting roll, increasing diameters in the central section of the casting roll, and thus causing the casting roll to "belly out" or "crown up" more for a given heat flux than when the casting roll was rotating faster. This results in a corresponding decrease in the strip cross-sectional profile due to the increased roll crown.

Figure 16:
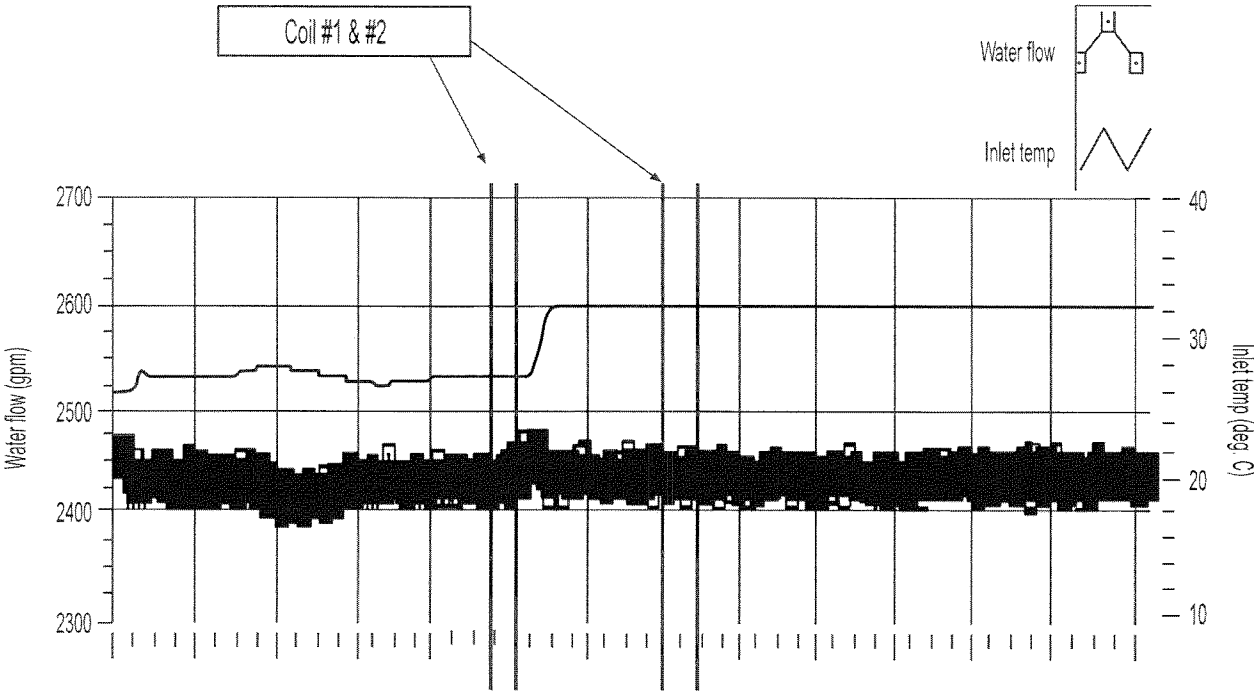
FIG. 16 is a graph illustrating water flow rate and water temperature at an inlet to time.

FIG. 16 is a graph illustrating a cooling water temperature increase from 27° C. to 32° C. during the course of particular casting run carried out at a constant casting speed. The graph of FIG. 16 also shows an analysis of the strip produced by the caster before and after the water inlet temperature change.

Coil #1 was cast strip at a selected time in the casting run before the water inlet temperature change, and Coil #2 was cast strip at a selected time in the casting run after the water inlet temperature change. In both cases the cast strip was analyzed to determine the thickness profile at that point in the casting run.

Figure 17:
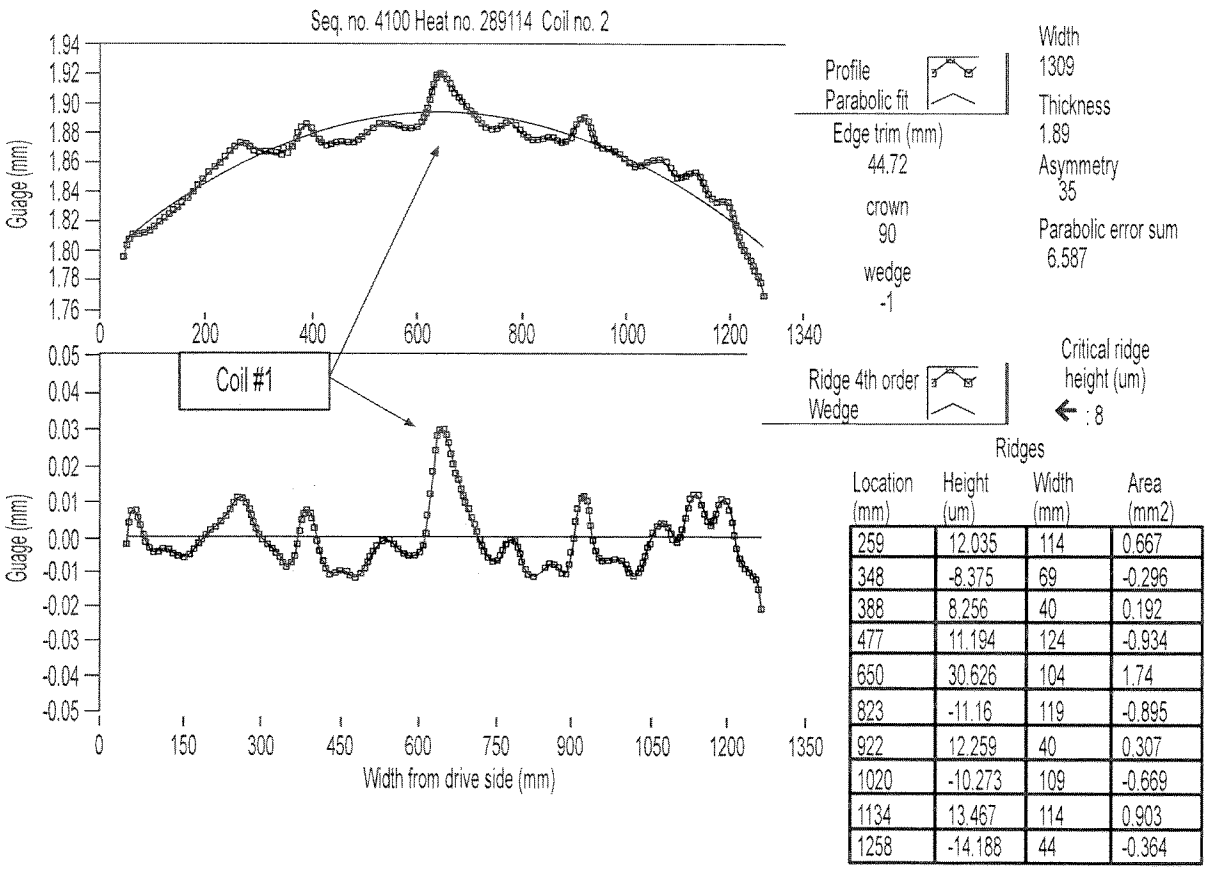
FIG. 17 is a graph illustrating strip gauge and roll crown to edge distance for a casting roll.
Figure 18:
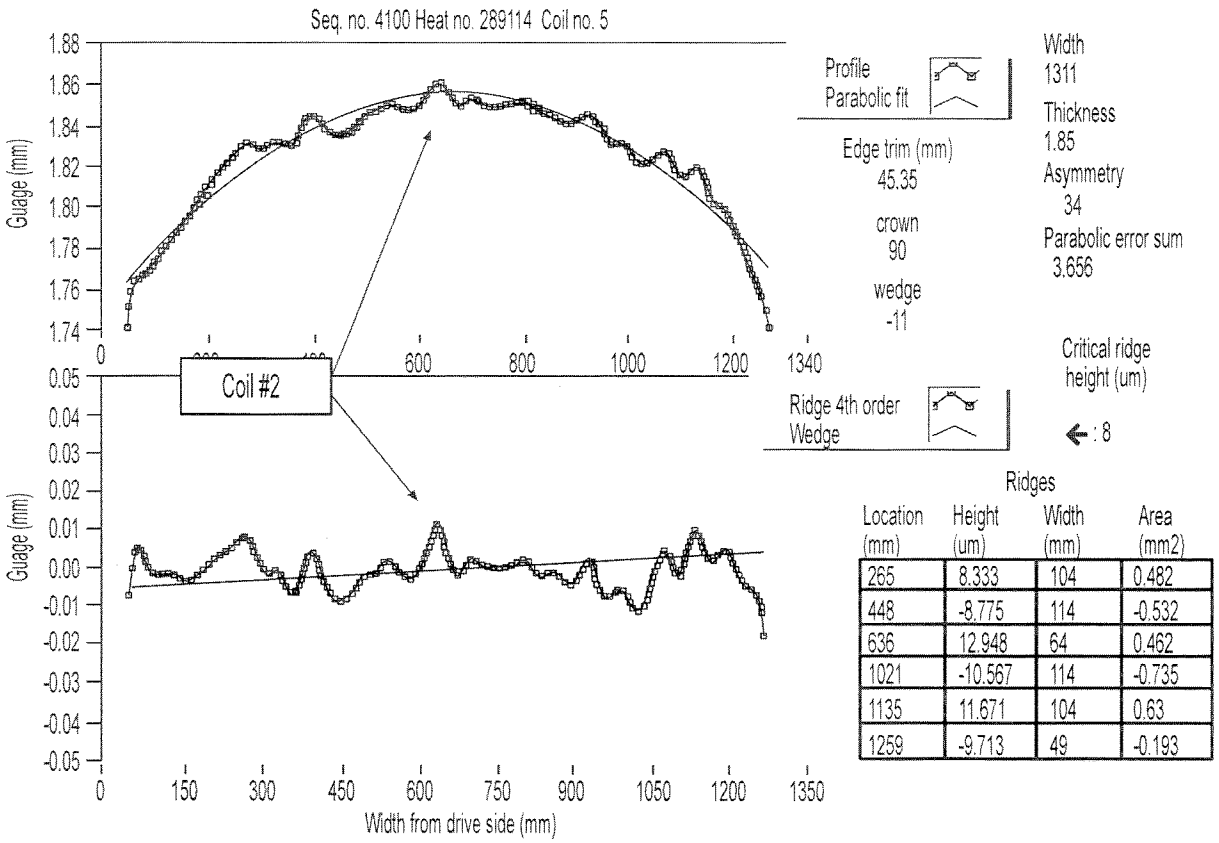
FIG. 18 is a graph illustrating strip gauge and roll crown to edge distance for another casting roll.

FIGS. 17 and 18 show the strip thickness profiles for the two tested sections of strip identified as Coil #1 and Coil #2 in FIG. 16. The graphs in FIGS. 17 and 18 illustrate that with a relatively higher cooling water temperature (Coil #2) the magnitude of the thickness perturbations, e.g. ridges, is lower than for a relatively lower cooling water temperature (Coil #1). The graphs in FIGS. 17 and 18 also illustrate that there is significant localized variations in strip thickness profile in strip produced by the caster prior to the increase in water temperature, which was significantly reduced with increase in water temperature. The localized variations in strip thickness are evident from the series of ridges (which indicate local thickness variations) across the width of the strip in each of the graphs in FIGS. 17 and 18. Controlling the temperature of the casting roll with change of the water inlet temperature demonstrates control for the shape of the roll crown and the strip thickness profile, as well as control over the range of localized variations in strip thickness profile. At a relatively higher cooling water temperature, the casting rolls expand more than at a relatively lower cooling water temperature and thus "crown up" more, thereby bringing the two cast shells of the thin cast strip closer together and reduce strip thickness profile. In this example, there is less molten metal being carried between the two shells in the cast strip with higher water temperature, than was the case with lower water temperatures where the two cast shells were farther apart and had greater bulging and different magnitude of ridges.

These examples illustrate control of the casting speed and the temperature of cooling water can control the crown of the casting surfaces of the casting rolls.

While principles and modes of operation have been explained and illustrated with regard to particular embodiments, it must be understood, however, that the invention may be practiced otherwise than as specifically explained and illustrated without departing from its spirit or scope.

What is claimed is:

1. A method of continuously casting thin strip by dynamically controlling roll crown comprising the steps of:

a. assembling a caster having a pair of counter rotating casting rolls with a nip there between capable of delivering cast strip downwardly from the nip with each casting roll having a casting surface formed by a cylindrical tube of a material selected from the group consisting of copper and copper alloy optionally with a coating thereon and having a plurality of longitudinal water flow passages extending through the tube having thickness of no more than 80 millimeters, the cylindrical tube capable of changing crown of the casting surface with changes in temperature of water flowing through the passages during casting, the cylindrical tube mounted between a pair of stub shaft assemblies having end portions within the ends of the cylindrical tube and supporting the cylindrical tube and forming an internal cavity therein the casting roll, b. assembling a metal delivery system capable of forming a casting pool supported on the casting surfaces of the casting rolls above the nip with side dams adjacent ends of the nip to confine the casting pool, c. positioning at least one sensor capable of sensing thickness profile of the cast strip downstream of the nip and generating electrical signals indicative of the thickness profile of the cast strip, d. controlling the temperature of the water flowing through the longitudinal water flow passages in the tube thickness, e. counter rotating the casting rolls and varying the speed of the casting rolls with a casting roll drive system, and f. controlling the casting roll drive to vary the speed of rotation of the casting rolls and varying the temperature of the water flow circulated through the water flow passages by a control system responsive to electrical signals received from the sensors to control roll crown of the casting rolls during a casting campaign.

2. The method of continuously casting thin strip by dynamically controlling roll crown as claimed in claim 1 where the thickness of the cylindrical tube is between 40 and 80 millimeters in thickness.

3. The method of continuously casting thin strip by dynamically controlling roll crown as claimed in claim 1 where the thickness of the cylindrical tube is between 60 and 80 millimeters in thickness.

4. The method of continuously casting thin strip by dynamically controlling roll crown as claimed in claim 1 comprising the additional step of:

assembling the casting rolls with longitudinal cavities and circulating the water through the water flow passages and the cavities of the casting rolls in series.

5. The method of continuously casting thin strip by dynamically controlling roll crown as claimed in claim 1 where water is circulated through the water flow passages and then through the cavity of at least one of the casting rolls.

6. The method of continuously casting thin strip by dynamically controlling roll crown as claimed in claim 2 where water is circulated through the cavity and then through the water flow passages of at least one of the casting rolls.

7. The method of continuously casting thin strip by dynamically controlling roll crown as claimed in claim 1 where water is circulated through the cavity of at least one of the casting rolls and then through the water flow passages.

8. The method of continuously casting thin strip by dynamically controlling roll crown as claimed in claim 2 where water is circulated through the water flow passages and then through the cavity of at least one of the casting rolls.

9. The method of continuously casting thin strip by dynamically controlling roll crown as claimed in claim 1 where water is circulated through the cavity of one of the casting rolls and then through the water flow passages and water is circulated through the cavity and then through the water flow passages of the other casting roll.

10. The method of continuously casting thin strip by dynamically controlling roll crown as claimed in claim 2 where water is circulated through the cavity of one of the casting rolls and then through the water flow passages and water is circulated through the cavity and then through the water flow passages of the other casting roll.

11. The method of continuously casting thin strip by dynamically controlling roll crown as claimed in claim 1 where positioning at least one sensor capable of sensing thickness profile of the cast strip is adjacent pinch rolls through which the strip next passes after casting.

12. The method of continuously casting thin strip by dynamically controlling roll crown as claimed in claim 1 where a plurality of sensors capable of sensing thickness profile of the cast strip are positioned laterally across the strip.

* * * * *